United States Patent [19]

Kelman

[11] Patent Number: 4,525,960

[45] Date of Patent: Jul. 2, 1985

[54] BASEMENT WALL INSULATING AND WATERPROOFING SYSTEM AND METHOD

[75] Inventor: Josh Kelman, Granville, Ohio

[73] Assignee: Owens-Corning Fiberglas Corporation, Toledo, Ohio

[21] Appl. No.: 575,364

[22] Filed: Jan. 30, 1984

[51] Int. Cl.[3] ..... E02D 19/16

[52] U.S. Cl. ..... 52/169.14; 52/169.11; 52/417; 52/746; 405/50

[58] Field of Search ..... 52/169.14, 169.5, 169.11, 52/408, 747, 748; 405/50, 416–420

[56] References Cited

U.S. PATENT DOCUMENTS

| | | | |
|---|---|---|---|
| 1,578,663 | 3/1926 | Innes | 52/417 |
| 3,754,362 | 8/1973 | Daimler et al. | 52/169.14 |
| 4,464,215 | 8/1984 | Cogliano | 52/746 |
| 4,470,237 | 9/1984 | Lincoln et al. | 52/420 |

FOREIGN PATENT DOCUMENTS

| | | | |
|---|---|---|---|
| 2370145 | 7/1978 | France | 52/169.14 |

OTHER PUBLICATIONS

Visking Company, Engineering News-Record, Jun. 27, 1957, p. 71.

*Primary Examiner*—Henry E. Raduazo
*Assistant Examiner*—Caroline Dennison
*Attorney, Agent, or Firm*—Ronald C. Hudgens; Ted C. Gillespie; Paul J. Rose

[57] ABSTRACT

Vertical stripes of asphalt are applied to the exterior of the basement wall, and glass fiber insulating boards with an asphalt coating on one side are applied to the exterior of the basement wall with the asphalt coating facing the wall and joints between boards disposed at the stripes.

2 Claims, 3 Drawing Figures

BASEMENT WALL INSULATING AND WATERPROOFING SYSTEM AND METHOD

TECHNICAL FIELD

This invention relates generally to waterproofing coatings and insulating boards applied to the exterior of basement walls, and more particularly to a system wherein most of the waterproofing coating normally applied directly to the wall can be omitted by taking advantage of a waterproof facing on the boards.

BACKGROUND ART

It is customary in building houses to apply a coating of asphalt sealer to the exterior of basement walls up to the ground line before backfilling. With increasing emphasis on energy conservation, it is also becoming customary to install insulating boards on the exterior of basement walls before backfilling.

DISCLOSURE OF INVENTION

In accordance with the invention, vertical stripes of waterproofing material are applied to the exterior of a basement wall at intervals determined by the width of insulating boards, and the insulating boards, which are glass fiber boards provided on one side with a facing of asphalt and kraft paper, are installed on the wall with the asphalt and kraft paper facing disposed adjacent the wall and joints between the boards located at the vertical stripes of waterproofing material.

BRIEF DESCRIPTION OF DRAWINGS

The invention is explained more fully hereinafter with reference to the accompanying drawings wherein.

BEST MODE OF CARRYING OUT THE INVENTION

Figure 1:
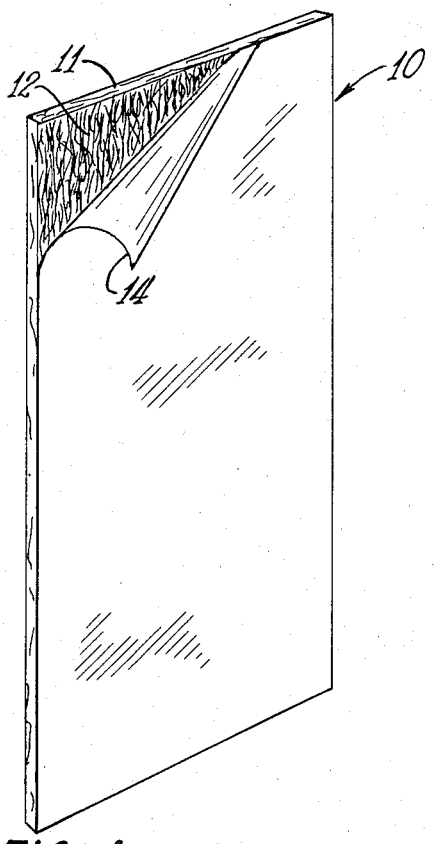
FIG. 1 is a perspective view of a glass fiber board facing with asphalt and kraft paper, the board being of the type used in the practice of the invention.

With respect to the drawings, FIG. 1 shows an insulating board 10 comprising a glass fiber board 11 having an asphalt coating 12 and a sheet of kraft paper 14 on one side. In the manufacture, hot asphalt 12 is applied to the board 11 and the paper 14 is applied immediately after the asphalt. The paper 14 becomes saturated with the asphalt.

Figure 2:
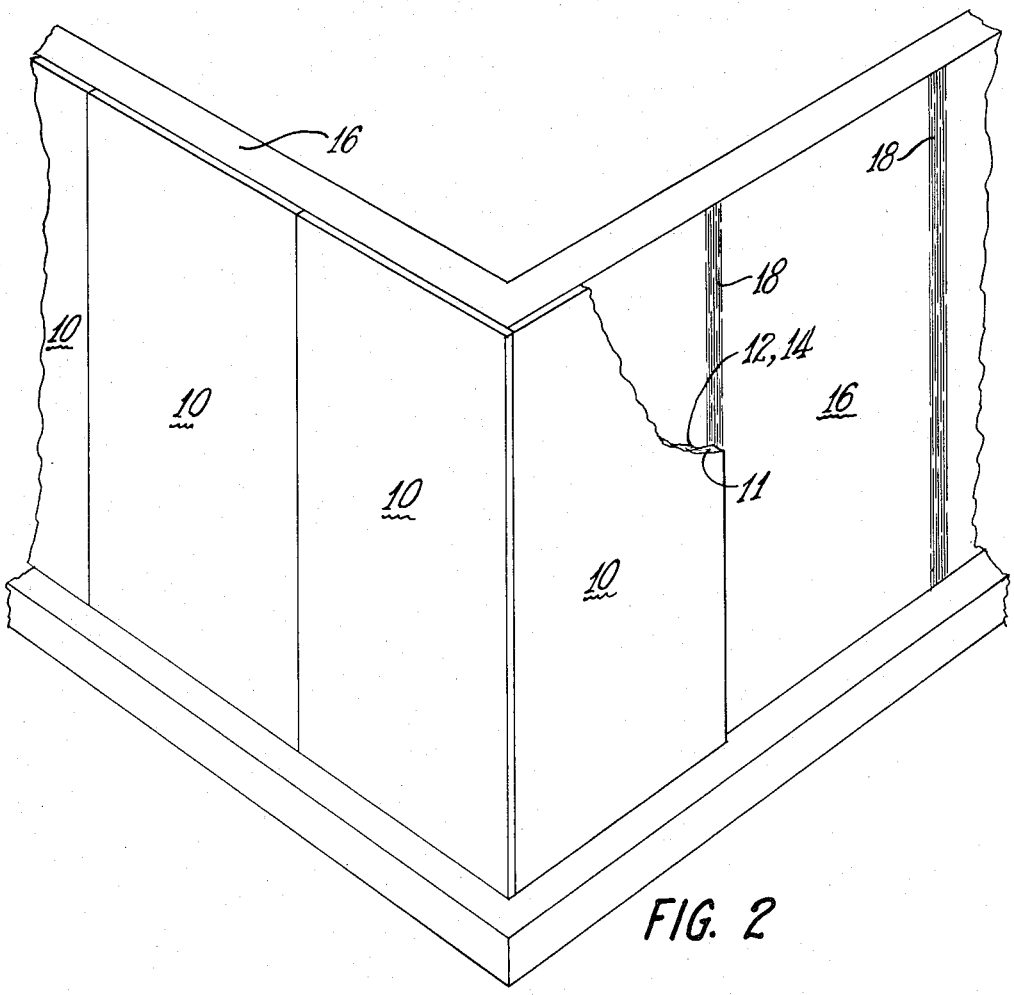
FIG. 2 is a fragmentary perspective view of a basement wall illustrating the waterproofing and insulating system of the invention.

FIG. 2 shows a basement wall 16 perferably of poured concrete or concrete blocks. Vertical stripes 18 of asphalt sealing compound are applied to the exterior of the wall 16 and spaced apart by approximately the width of a board 10. Boards 10 are then put in place with the asphalt coating 12 and paper 14 facing the wall 16. If desired, additional asphalt may be applied to the boards 10 before they are put in place, at vertical edge portions cooperating with the stripes 18. The boards 10 insulate the wall 16, and the asphalt coating 12 on each board, which becomes integral with the paper 14, seals the wall 16 between the respective stripes 18. Thus, it is not necessary to fully coat the wall 16 with asphalt sealer. In addition, the glass fiber board 11 allows water to drain down to a drain tile 20 shown in FIG. 3.

Figure 3:
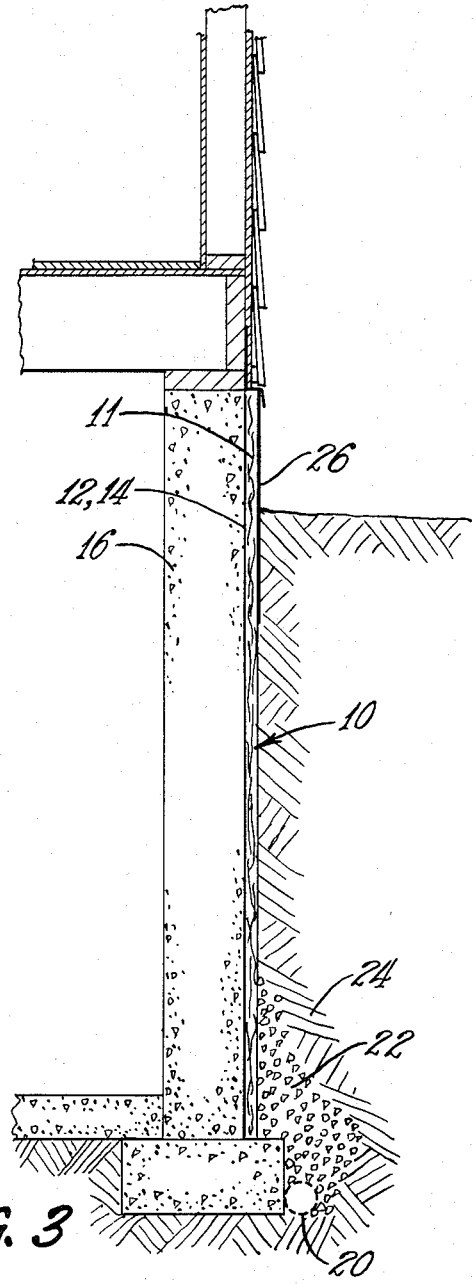
FIG. 3 is a vertical section through a basement wall having the waterproofing and insulating system of the invention applied thereto and showing other details.

FIG. 3 shows the basement wall 16 and a board 10 after backfilling of the foundation hole. Gravel 22 is installed over the tile 20 before dirt 24 is replaced. A protective cover 26 is provided for the portion of the board 10 above ground.

I claim:

1. An insulating and waterproofing system for a basement wall, the system comprising asphalt sealing compound on the exterior of the basement wall, only partially covering the wall, and being present in vertical stripes spaced apart by approximately the width of an insulating board, and a plurality of the insulating boards installed on the exterior of the wall in abutting relationship to each other, joints between pairs of adjacent boards being located respectively at the vertical stripes of asphalt sealing compound, each insulating board comprising a glass fiber board coated on one side with asphalt and kraft paper, and the boards being disposed with the asphalt and kraft paper facing the basement wall.

2. A method of insulating and waterproofing a basement wall comprising applying spaced-apart vertical stripes of asphalt sealing compound to the exterior of the wall, and applying a plurality of insulating boards to the exterior of the wall in abutting relationship to each other, the joints between pairs of adjacent boards being disposed respectively at the stripes, each insulating board comprising a glass fiber board having a coating of asphalt and kraft paper on one side, and the insulating boards being disposed with the asphalt and kraft paper facing the wall.

* * * * *